US005119656A

United States Patent [19]

Kobayashi et al.

[11] Patent Number: 5,119,656

[45] Date of Patent: Jun. 9, 1992

[54] ROLLING MILL WITH OFFSET WORK ROLLS POSITIONED AND CONTROLLED BY SUPPORT ROLLS AND METHOD OF USING SAME

[75] Inventors: Kazuo Kobayashi, Toukai; Toshiyuki Kajiwara, Hitachi; Takao Sakanaka, Hitachi; Hiromitsu Mitsui, Hitachi; Kenichi Yasuda, Katsuta, all of Japan

[73] Assignee: Hitachi, Ltd., Japan

[21] Appl. No.: 579,039

[22] Filed: Sep. 7, 1990

[30] Foreign Application Priority Data

Sep. 8, 1989 [JP] Japan ..... 1-231602

[51] Int. Cl.[5] ..... B21B 13/14; B21B 31/16; B21B 37/08

[52] U.S. Cl. ..... 72/21; 72/241.8; 72/243.4

[58] Field of Search ..... 72/241.2, 241.4, 241.6, 72/241.8, 242.2, 242.4, 243.2, 243.4, 243.6, 9, 12, 8, 21, 247

[56] References Cited

U.S. PATENT DOCUMENTS

| | | | |
|---|---|---|---|
| 1,887,870 | 11/1932 | Coe | 72/241.2 |
| 4,059,002 | 11/1977 | Rommen et al. | 72/241.8 |
| 4,598,566 | 7/1986 | Bald et al. | 72/243.2 |
| 4,631,948 | 12/1986 | Bald et al. . | |
| 4,691,548 | 9/1987 | Richter et al. | 72/21 |
| 4,719,784 | 1/1988 | Matsumoto et al. . | |
| 4,724,698 | 2/1988 | Ginzburg | 72/243.4 |
| 4,736,609 | 4/1988 | Schiller et al. | 72/241.2 |

FOREIGN PATENT DOCUMENTS

| | | | |
|---|---|---|---|
| 0149247 | 7/1985 | European Pat. Off. | 72/243.2 |
| 0159796 | 10/1985 | European Pat. Off. | 72/241.2 |
| 3200654 | 8/1982 | Fed. Rep. of Germany . | |
| 0151111 | 11/1981 | Japan | 72/8 |
| 0091801 | 6/1982 | Japan | 72/8 |
| 0168714 | 10/1982 | Japan | 72/247 |
| 0150604 | 8/1984 | Japan | 72/243.4 |
| 0018206 | 1/1985 | Japan | 72/243.4 |
| 60-18206 | 1/1985 | Japan . | |
| 0189809 | 8/1986 | Japan | 72/241.2 |
| 0286010 | 12/1986 | Japan | 72/243.2 |
| 63-313024 | 1/1988 | Japan . | |
| 63-60006 | 3/1988 | Japan . | |
| 2139126 | 11/1984 | United Kingdom . | |

OTHER PUBLICATIONS

Patent Abstracts of Japan, vol. 12, No. 282 (M-726), Aug. 3, 1988; & JP-A-6306006 (Kawasaki Heavy Ind. Ltd.) Mar. 16, 1988.

Patent Abstracts of Japan, vol. 9, No. 135 (M-386), Jun. 11, 1985; & JP-A-60018206 (Nihon Rooru Seizou K.K.) Jan. 30, 1985.

*Primary Examiner*—Lowell A. Larson
*Assistant Examiner*—Thomas C. Schoeffler
*Attorney, Agent, or Firm*—Evenson, Wands, Edwards, Lenahan & McKeown

[57] ABSTRACT

A rolling mill for rolling metal strip moving in a horizontal rolling direction, has work rolls which engage the strip and are supported vertically by backup rolls through which drive is applied. The work rolls are supported in the horizontal rolling direction by support rollers contacting them at locations confined to intermediate regions between the work regions and bearings. The work rolls are shiftable in the horizontal rolling direction. To provide control of the horizontal forces during rolling, there are position control means for the support rollers operable to move and locate the support rollers so as to shift the work rolls to a predetermined location at which the vertical axial plane of the work rolls is offset in the horizontal rolling direction from the vertical axial plane of the backup rolls. The support rollers maintain the work rolls at the predetermined location during rolling.

24 Claims, 8 Drawing Sheets

5a
9
9
10
13
8
7
5
12
4
4
12
1
5
6
12
4
4
12
11
7
8
9
10
9
F
9
10

ROLLING MILL WITH OFFSET WORK ROLLS POSITIONED AND CONTROLLED BY SUPPORT ROLLS AND METHOD OF USING SAME

BACKGROUND OF THE INVENTION

1. FIELD OF THE INVENTION

The present invention relates to a rolling mill and rolling method, and more particularly to a rolling mill and a rolling method for metal strip, in which relatively small-diameter working rolls suitable for rolling hard, thin material are used.

2. DESCRIPTION OF THE PRIOR ART

A rolling mill for rolling metal strip, particularly hard, very thin material such a stainless steel, high carbon steel, spring steel and some alloy steels such as titanium alloy and high nickel alloy steels, uses small-diameter working rolls. Since such working rolls have too small a diameter for application of the rolling torque directly to them, there have been developed multiple-roll rolling mills such as the Sendzimir mill and other mills in which the drive is transmitted to the working rolls via one or more pairs of backup rolls through which drive is transmitted to the working rolls. Methods have also been developed for controlling the bending of the work rolls in such rolling mills, in order to achieve flatness of the product, by relative shifting of the backup rolls in the axial direction and also by applying vertical roll bending forces to the work rolls and the backup rolls.

The present invention is concerned with control of bending in the horizontal rolling direction, i.e. in the direction of travel of the material being rolled. This direction is referred to herein as the "horizontal direction" or "horizontal rolling direction" and these expressions do not include the axial direction of the rolls.

Since bending of the rolls in the horizontal direction increases with decrease of roll diameter, it imposes a limit on the reduction of roll diameter. The roll bending phenomenon in the horizontal direction is discussed more below.

U.S. Pat. No. 4,631,948 discloses a rolling mill in which drive is transmitted to the work rolls by backup rolls, and the work rolls are offset from the axial plane of the backup rolls in the horizontal direction. It is known that horizontal bending of the work rolls is reduced by offsetting the working roll axial plane from the backup roll axial plane in the direction downstream (in the rolling direction) of the backup roll plane because the frictional force applied by the backup rolls to the work rolls is then in opposition to the horizontal component of the rolling force (i.e. the force applied to the material being rolled by the work rolls). In U.S. Pat. No. 4,631,948, the work rolls are maintained in a fixed horizontal position in the mill frame, offset relative to the backup rolls, and are supported in the horizontal direction by rollers which contact the work rolls at portions thereof which are outside the region contacting the roll material but are of the same diameter as that region. The support rolls, which are on both sides of the work rolls in the horizontal direction, are forced against the work rolls hydraulically and serve to control horizontal bending, by applying bending forces to the rolls horizontally between their fixed bearing blocks. It is stated that the hydraulic cylinders which push the support rollers are independently controlled to produce the desired bending. However, in this mill because the bearing blocks are in a fixed horizontal position in the mill frame, appropriate control of the horizontal forces which vary in dependence not only on the rolling direction but also various other factors during rolling such as torque and rolling force, is not possible.

JP-A No. 63-60006 (1988) shows an arrangement closely similar to that of U.S. Pat. No. 4,361,948, in which again the bearing blocks of the work rolls are horizontally fixed.

JP-A No. 60-18206 (1985) shows a similar application of rollers to both sides of both ends of both work rolls, to provide horizontal support of the work rolls. In this case the rollers which are paired are applied by a mechanical adjustment system against the work rolls. All of the rollers are apparently adjustable in the horizontal direction, but there is no suggestion or control of the horizontal position of the work rolls which are shown with their axes in the vertical plane of the axes of backup rolls. It is stated that the journal bearings of the work rolls may be removed, presumably since all horizontal force is controlled by the rollers. No vertical roll bending is employed. If it is additionally required to apply vertical bending forces for vertical roll bending, it is not possible to remove the journal bearings since the vertical force must be applied through such bearings. In summary, this prior art disclosure suggests no solutions to the problems of control of vertical or horizontal roll bending.

JP-A No. 63-13024 (1988) in contrast describes the horizontal positioning of the work rolls by means of hydraulic cylinders acting on their bearing blocks. While this approach can restrict the amount of horizontal bending, by positioning the rolls appropriately for each rolling operation, it cannot supply any solution to the problem of out-of-plane bending in the horizontal direction arising from the relatively small resistance to bending of the small diameter work rolls.

Control of bending of the work rolls across the whole width of the work rolls is provided by a system of support rolls, such as in a Sendzimir rolling mill mentioned above. Another example is disclosed in U.S. Pat. No. 4,719,784, where a system of two support rolls in succession are carried by arms projecting from a support beam extending across the mill. The support beam carries a plurality of axially spaced rolling bearings providing horizontal support of the support rollers. The plane of the axes of the work roll, the two support rolls and the bearings is nearly horizontal. While such an arrangement provides good horizontal support of the work roll, it has the problem that the spaced bearings mark the support roll and these marks are transferred to the work roll, leading to transfer marking of the rolled product. Another problem is that the support rolls interfere with cooling of the work rolls.

SUMMARY OF THE INVENTION

The object of the invention is to provide control of the horizontal bending of the work rolls and in particular to permit the reduction of work roll diameter by appropriately balancing the forces arising and reducing their effects upon the work rolls.

Another object is to provide a rolling method which results in good shape of the rolled product by reduction of horizontal bending of the work rolls.

It should be remembered that the phenomenon of the bending of the work rolls in the horizontal plane has not yet been fully clarified.

If the work rolls are convexly bent toward the entrance side of the rolled strip, the strip comes into contact with the work rolls earlier at its central region than at the edge regions, so that the central region becomes thinner than the edge regions. If, on the contrary, the work rolls are concavely bent toward the strip entrance side, the edge regions come into contact with the work rolls earlier so that they become thinner than the central region. These phenomena cannot be analyzed merely by the geometric calculations of the vertical roll gap due to the horizontal warp of the working rolls, and it must be taken into consideration that the work roll axes fails to intersect the strip movement direction at a right angle due to their bending so that vectors are exerted to shrink or widen the strip in its width directions.

If the work rolls are bent in the horizontal direction, shape changes are added to the thickness distribution. Unless shape controls are accomplished without considering the additional shaping disturbances caused by the horizontal bending of the working rolls, there arises a problem that the shape is varied between the forward and backward paths. There is another problem that the control systems are complicated.

The present invention makes it possible to overcome the problems discussed above and provides the novel concept of combining firstly shifting the work rolls to a desired offset location relative to the vertical backup roll plane by means of position control of support rollers which engage the work rolls outside the work regions and secondly application of force to control horizontal work roll bending through these support rollers. The bearings of the work rolls are horizontally shiftable, preferably being substantially unrestrained in the horizontal rolling direction, even during rolling.

The invention provides several advantages. Horizontal bending of the work rolls is reduced firstly by their offset location during rolling and secondly by the control force applied by the support rollers. The location of the support rollers between the work regions and the bearings, preferably at the full barrel diameter of the work rolls, reduces the free span of the work rolls, which also reduces horizontal bending, and avoids marking of the rolled strip by transfer marks from bearings. Additionally good cooling of the work rolls is possible. The free horizontal movement of the bearing boxes leads to a simple construction.

In the invention, the application of forces to control vertical bending e.g. through the bearings, and the application of forces to control horizontal bending through the support rollers can be independent, permitting excellent and accurate control of the work roll bending.

In one aspect, the present invention provides a rolling mill for rolling metal strip moving in a horizontal rolling direction, having a. a pair of work rolls having axes defining a vertical rolling plane, and central work regions engaging strip being rolled, b. a pair of backup rolls having axes defining a vertical backup roll plane and contacting the work rolls to support them in the vertical direction and arranged to transmit rotational drive to the work rolls, c. bearings for the axial ends of the work rolls to restrain axial movement of the work rolls, the bearings being horizontally shiftable in the horizontal rolling direction, and d. a plurality of support rollers for the work rolls providing support therefor in the horizontal rolling direction and contacting the work rolls at locations which are confined to intermediate regions of the work rolls between the work regions and the bearings, the support rollers being displaceable so as to locate and restrain the work rolls at a plurality or range of selectable positions in the horizontal rolling direction at which positions the vertical rolling plane is offset from the vertical backup roll plane.

Preferably both work rolls are supported by the support rollers on both sides in the horizontal rolling direction. The support rollers are preferably displaceable so that the selectable positions of the work rolls include positions of the work roll axes at both sides of the backup roll plane.

Especially to provide good control of horizontal work roll bending, the support rollers at a first side of the work rolls are mounted by mounting means providing position control of the support rollers on that side, and the support rollers at the other side of the work rolls are mounted by means providing control of the force applied by the support rollers on that other side to the work rolls. At the first side, the mounting means preferably provides mechanically adjustable predetermined location of the support rollers and at the other side the mounting means applies an adjustable force hydraulically to the support rollers.

In one embodiment, at each intermediate region of the work rolls contacted by the support rollers, there are at least two of the support rollers spaced apart in the axial direction of the work roll. These two support rollers are preferably rigidly linked to each other so as together to resist bending of the work roll in the horizontal rolling direction. This increases the effective length of the work roll to which the force controlling horizontal roll bending is applied.

The rolling mill of the invention preferably has control means for the support rollers adapted and arranged to move all the support rollers preferably in unison in the same direction so as to move the work rolls to a predetermined offset location.

The invention further provides a method of operating a rolling mill for metal strip wherein the strip moving in a horizontal rolling direction is rolled by a pair of work rolls which are driven and supported vertically by a pair of backup rolls and are supported in the horizontal rolling direction by a plurality of support rollers which engage locations of the work rolls confined to intermediate regions between work regions where the work rolls contact strip being rolled and bearings for the work rolls. The method is characterized by displacing the support rollers so as to move the work rolls to a predetermined offset position at which the vertical rolling plane in which their axes lie is offset from the vertical backup roll plane in which the axes of the backup rolls lie, and thereafter maintaining the position of the support rollers so as to maintain the work rolls at the predetermined offset position during a rolling operation. The predetermined position is selected so that the bending forces tending to bend the work rolls in the horizontal rolling direction during the rolling operation are less when the work rolls are at the predetermined offset location than when the vertical rolling plane coincides with the vertical backup plane.

While the present invention is not limited by theory, there will now be given some further explanation of the roll-bending phenomena involved.

The horizontal deflection or bending of the working rolls can in a simple case be considered as is shown in FIG. 4(*a*) on the basis of the formulas of the strength of materials. What is the most important here is the deflection at the region where the work rolls contact the material to be rolled, as expressed in the following equation:

$$\Delta_1=(Q/384EI).W^2.(12L-7W) \quad (1).$$

wherein $\Delta_1$: the deflection of the work rolls at their region contacting the rolled material;

Q: the horizontal bending force;

W: the width of the material;

L: the distance between fulcrums;

E: the modulus of elasticity of the work rolls; and

I: the geometrical moment of inertia of the work rolls.

It is understood from the equation (1) that reductions in the horizontal force and the interfulcrum distance are effective for reducing the bending of the work rolls.

If, moreover, another pair of fulcrums are added outside the first fulcrums, as shown in FIG. 4(*b*), so that the restriction of the supports is accomplished to reduce the displacements at load points $R_2$ and $R_3$ to zero, the deflection ($\Delta_2$) is expressed in the following:

$$\Delta_2 = \frac{Q}{384EI} \quad \frac{W(6L^3 + 24lWL - 3LW^2 - 14lW^2}{2l + 3L} \quad (2)$$

wherein l is the distance between the two fulcrums on each side.

In dependence upon the individual size relationships, according to the arrangement of FIG. 4(*b*), the warp of the working rolls can be reduced to about one third, as compared with the arrangement of FIG. 4(*a*), if practical sizes are adopted.

Thus, it is a major feature of the present invention to optimize the structure in accordance with the teaching of the strength of materials thereby to prevent or reduce the horizontal bending of the working rolls.

A first effect of the present invention is to reduce the horizontal bending force, which is achieved by moving the work rolls in the horizontal rolling direction to a position at or closer to the ideal dynamically balanced position where the horizontal force is balanced with respect to the rolling load, the driving tangential force and the difference between the front and back tensions of the strip being rolled.

A second effect is to improve the rigidity against the deflection of the work rolls with respect to the fluctuating disturbances and errors which cannot be prevented by the first effect.

Other effects which can be achieved are countermeasures against hysteresis and the simplification of the structure.

One problem is the reduction in the interfulcrum distance. Generally speaking, the interbearing distance at the two end portions of the rolls is 1.5 times as large as the maximum width of rolled material. If the roll barrel portions are provided with the support rollers, that distance can be effectively reduced to about 1.1 times, and the bending of the working rolls can, according to equation (1) above, be reduced to about one half, as follows:

$$\frac{12 \times 1.1 - 7}{12 \times 1.5 - 7} = \frac{6.2}{11} = 0.56$$

Next, if not the free support shown in FIG. 4(*a*) but the support capable of establishing a fixed moment shown in FIG. 4(*b*) is adopted for the reaction supporting method of the working rolls, the bending of the work rolls can be reduced about one third in the case of FIG. 4(*b*), as compared with that of FIG. 4(*a*). In this case, however, the reaction $R_2$ is ($R_2+Q/2$), which is larger by $R_3$ than that of FIG. 4(*a*). For 1/0.1 and L/W=1.1, for example, the value $R_3$ becomes substantially equal to Q/2, which is about two times as large as the value $R_1$ of FIG. 4(*a*).

In order to suppress the value $R_2$, it is conceivable to increase the value 1. However, the work rolls are then elongated raising their cost. In order to adopt the present method practically, therefore, the small-diameter support rollers cannot be adopted in the narrow space of the rolling mill using small-diameter work rolls without making the offset of the work rolls variable to reduce the horizontal force thereby to reduce the absolute value of the load to be applied by the support rollers.

How much the diameter of the rolls can be reduced, at least theoretically, in the present invention as compared with the prior art is enumerated in the following Table. Here, the horizontal force to be applied to the working rolls can be controlled to 10% to 20% or less because of the variable offset and is assumed at 25% for the purpose of these calculations.

TABLE

| Method | Inter-Fulcrum Distance (L) | Horizontal Force | Horizontal Warp | Allowable Min. Dia. |
|---|---|---|---|---|
| A. Work roll bearings fixed | 1.5 | 100% | 100% | 100% |
| B. Variable offset of work rolls | 1.5 | 25% | 25% | 71% |
| C. Short inter-fulcrum distance | 1.1 | 100% | 56% | 87% |
| D. Free support - invention | 1.1 | 25% | 0.56 × 0.25 = 14% | 61% |
| E. Fixed support - invention | 1.1 | 25% | 0.56 × 0.25 × ⅓ = 4.7% | 46% |

Methods D and E above are examples of the present invention and correspond to the cases of FIGS. 4(*a*) and 4(*b*) respectively.

Thus according to the present invention, the work rolls can have their diameters reduced more than in the prior art while avoiding flaws in the material due to the presence of the horizontal support rollers, supplying rolled products having an excellent surface quality. Since, moreover, a vertical bending for the shape control can additionally be exerted upon the working rolls, the shape of the product can be well controlled. In respect of the horizontal bending disturbances of the work rolls, the horizontal force can be reduced by the offset adjustment. In respect of the errors, the work rolls can be supported highly rigidly only against the horizontal bending so that the disturbances can be prevented to maintain good shape of the rolled products. By the means thus far described, very thin, hard materials can be stably rolled and produced by making use of the small-diameter working rolls.

BRIEF INTRODUCTION OF THE DRAWINGS

Embodiments of the present invention will be described in detail in the following, by way of non-limitative example, with reference to the accompanying generally diagrammatic drawings. In the drawings.

Figure 4A:
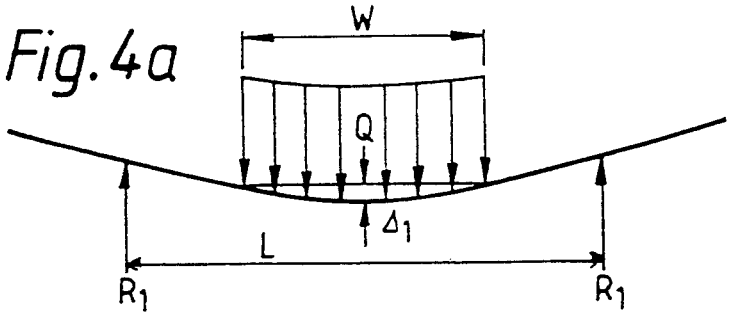
Figure 4B:
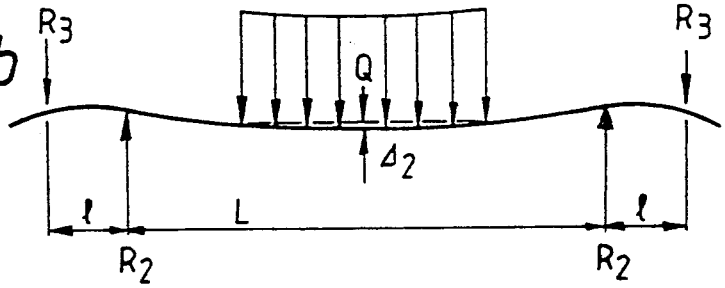
Figure 8:
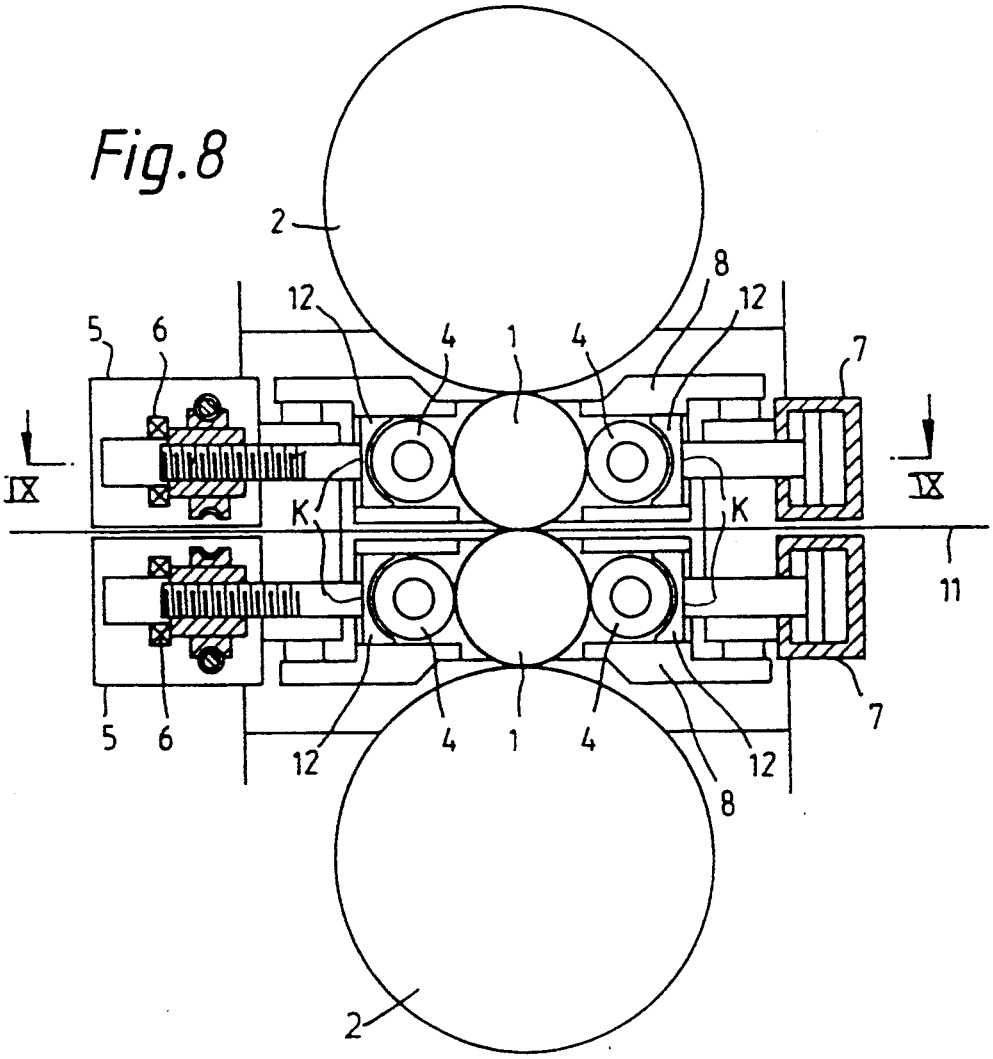
Figure 5:
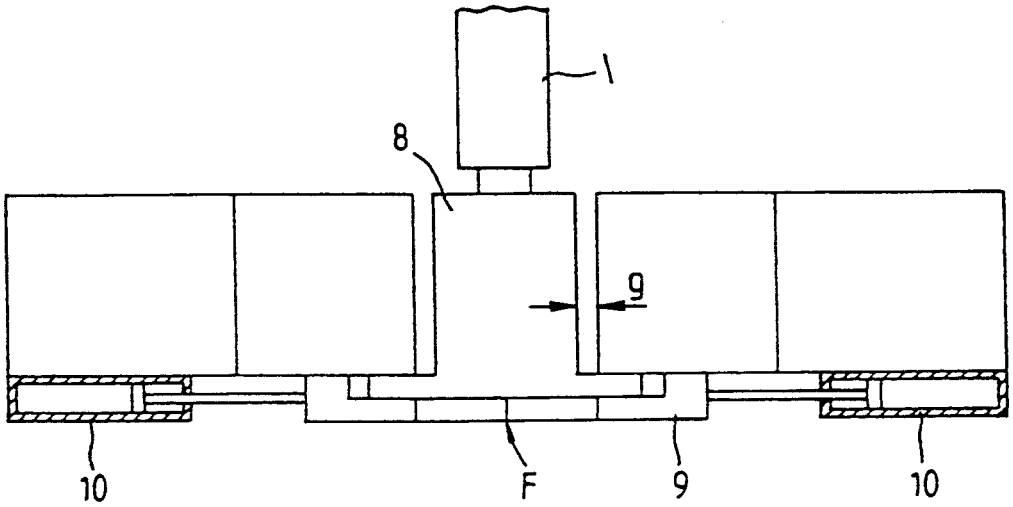
Figure 6:
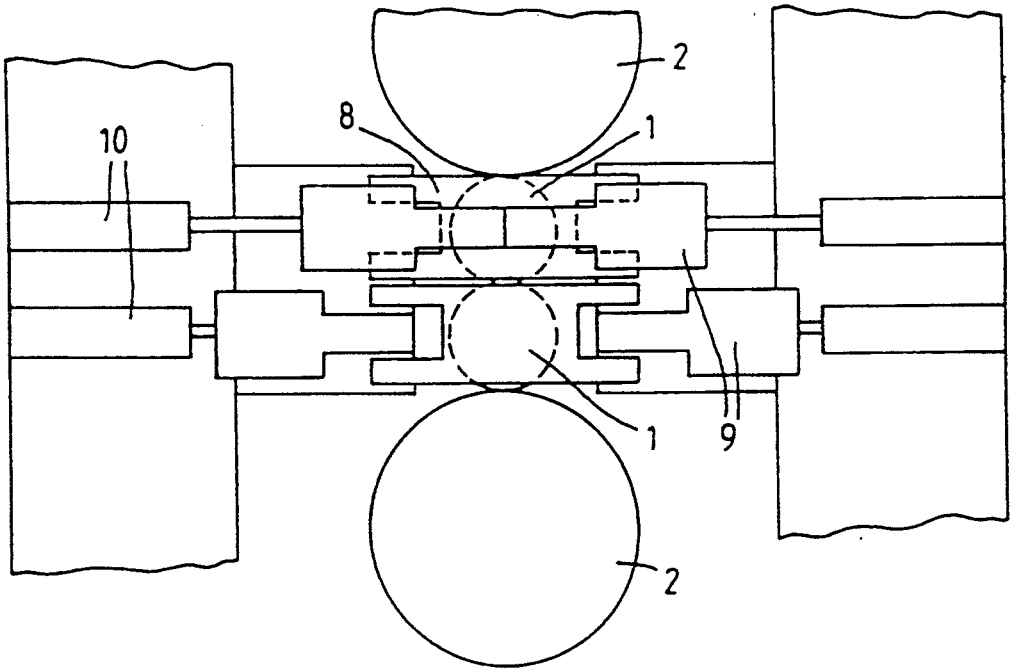
Figure 7:
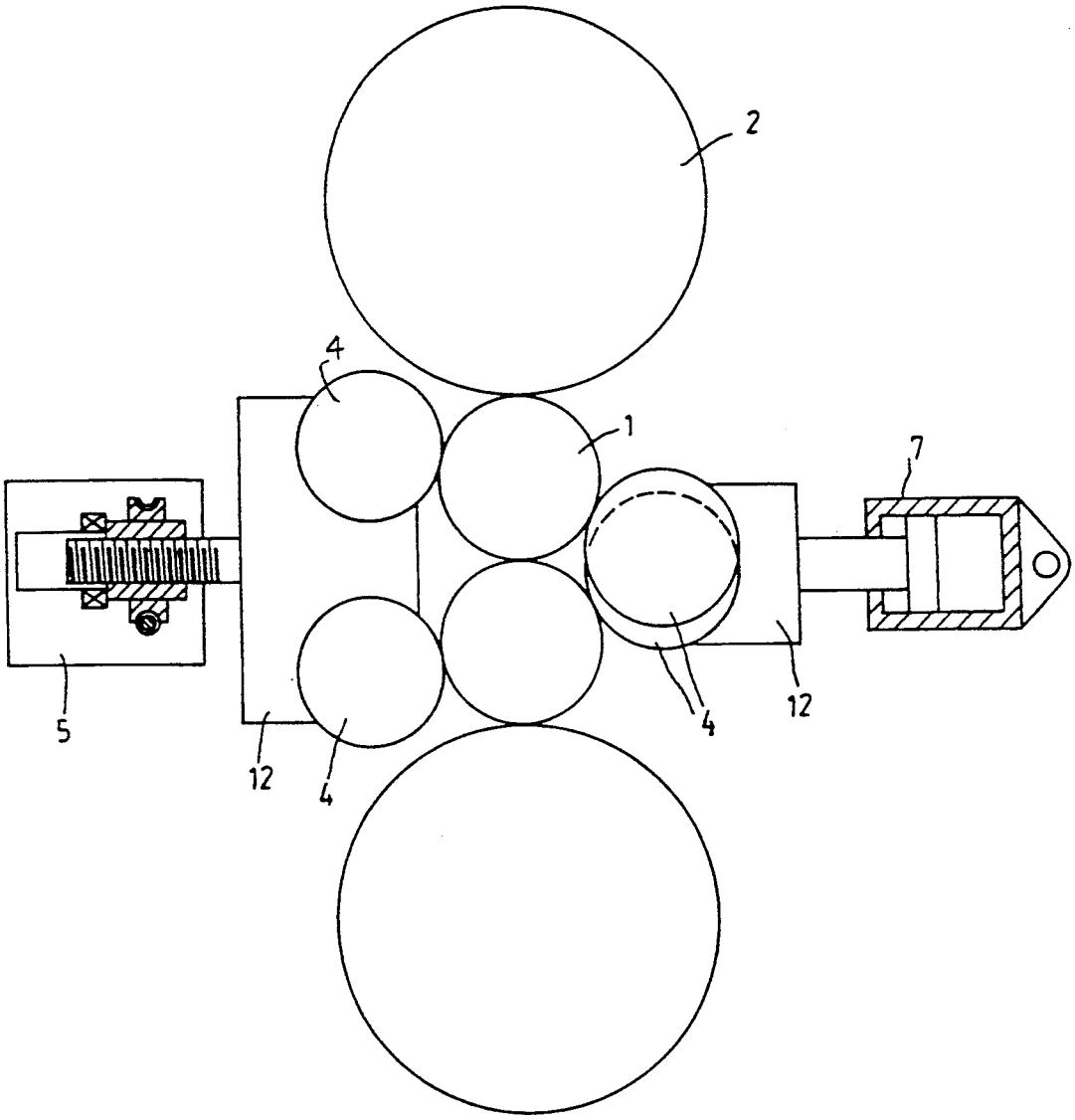
Figure 9:
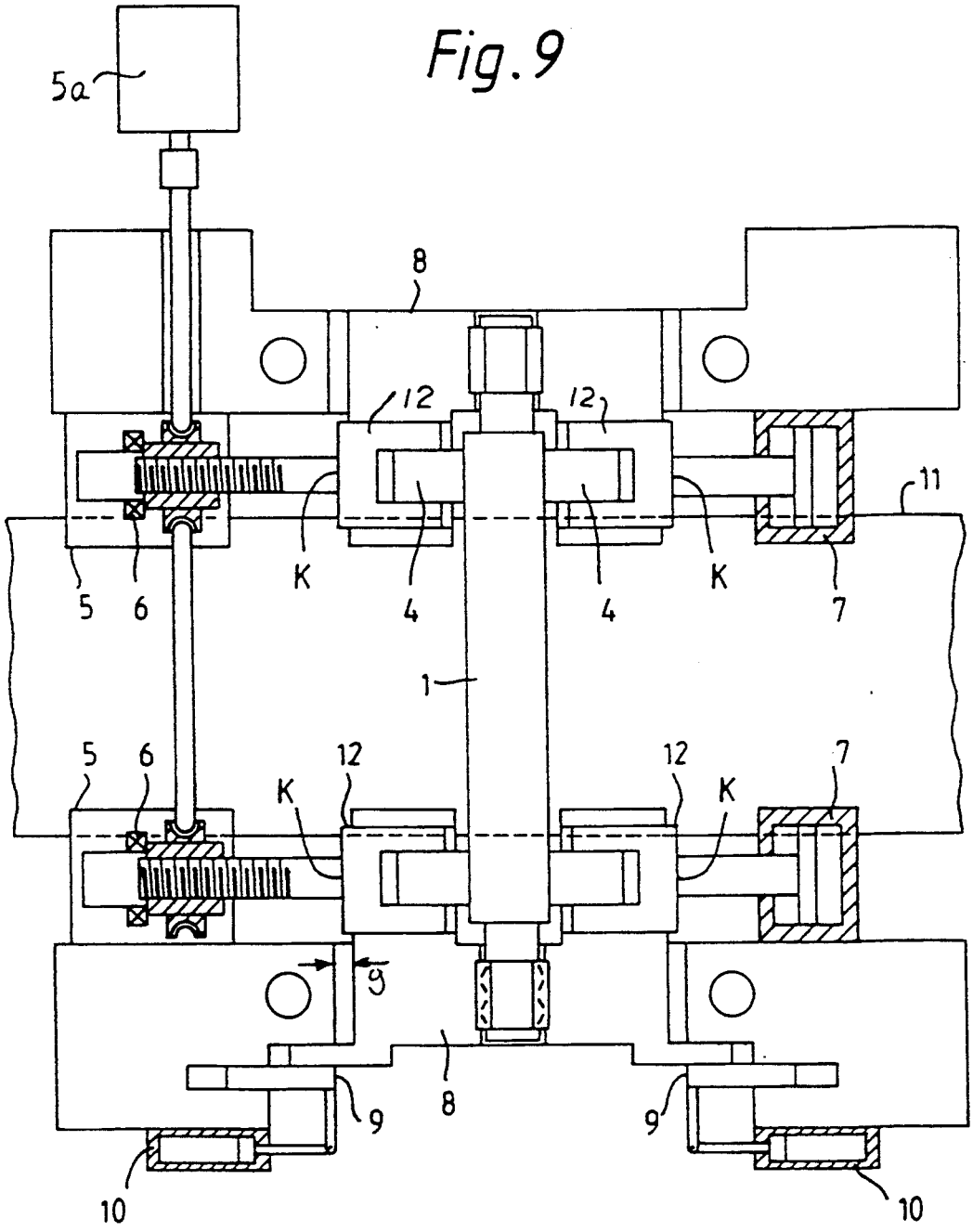
Figure 10:
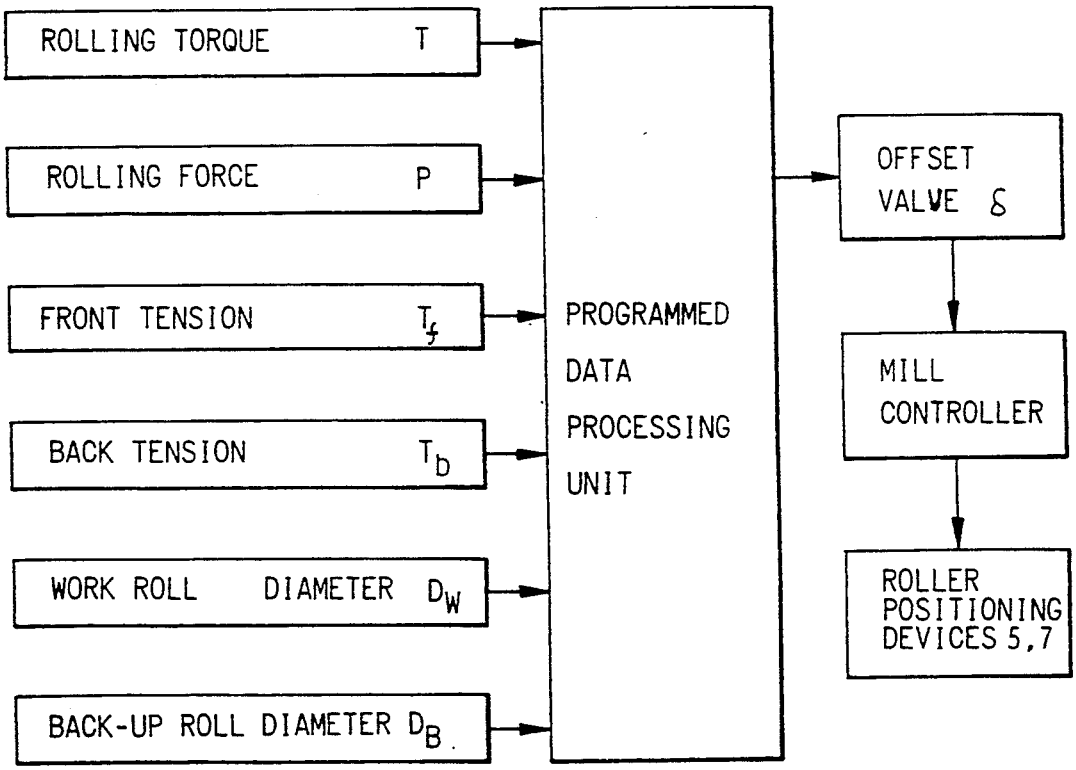

FIGS. 4(*a*) and 4(*b*) are diagrams for explaining the bending of the work rolls;

FIG. 5 is a partial detailed view showing another example of the arrangement at the end portion of a working roll in an embodiment of the invention;

FIG. 6 is a side elevation of the rolling mill of FIG. 5;

FIG. 7 is a diagrammatic vertical section showing still another embodiment of the present invention;

FIG. 8 is a vertical section of another rolling mill embodying the invention;

FIG. 9 is a section, on the line IX—IX of FIG. 8 of the mill of FIG. 8; and FIG. 10 is a diagram of a control apparatus useful in the present invention.

DESCRIPTION OF THE PREFERRED EMBODIMENTS

The several embodiments described have corresponding parts indicated by the same reference numerals, and for brevity the description of such corresponding parts is not repeated.

Figure 1:
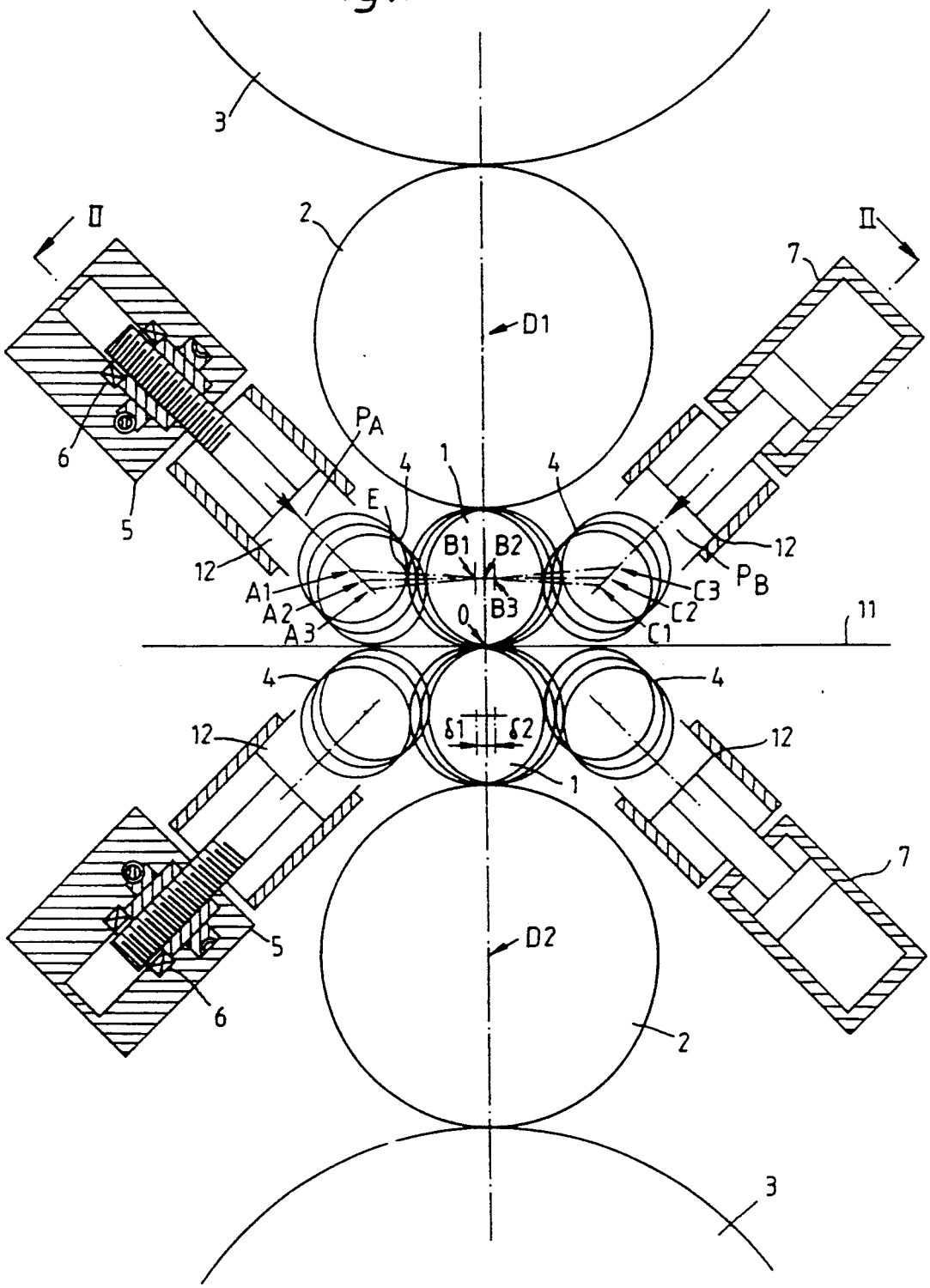
FIG. 1 is a vertical section of one embodiment of the rolling mill of the present invention.
Figure 2:
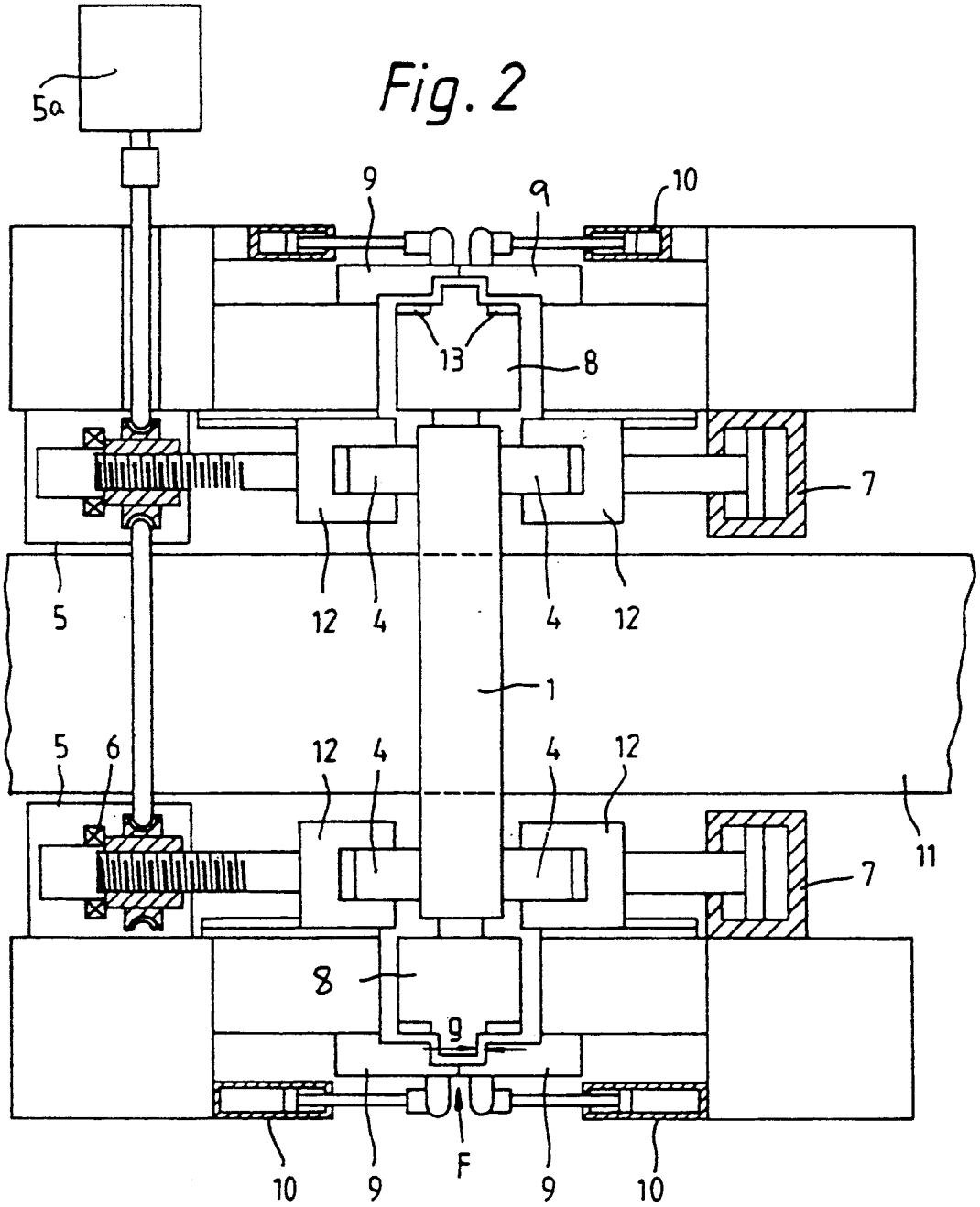
FIG. 2 is a section along the line II—II of FIG. 1.
Figure 3:
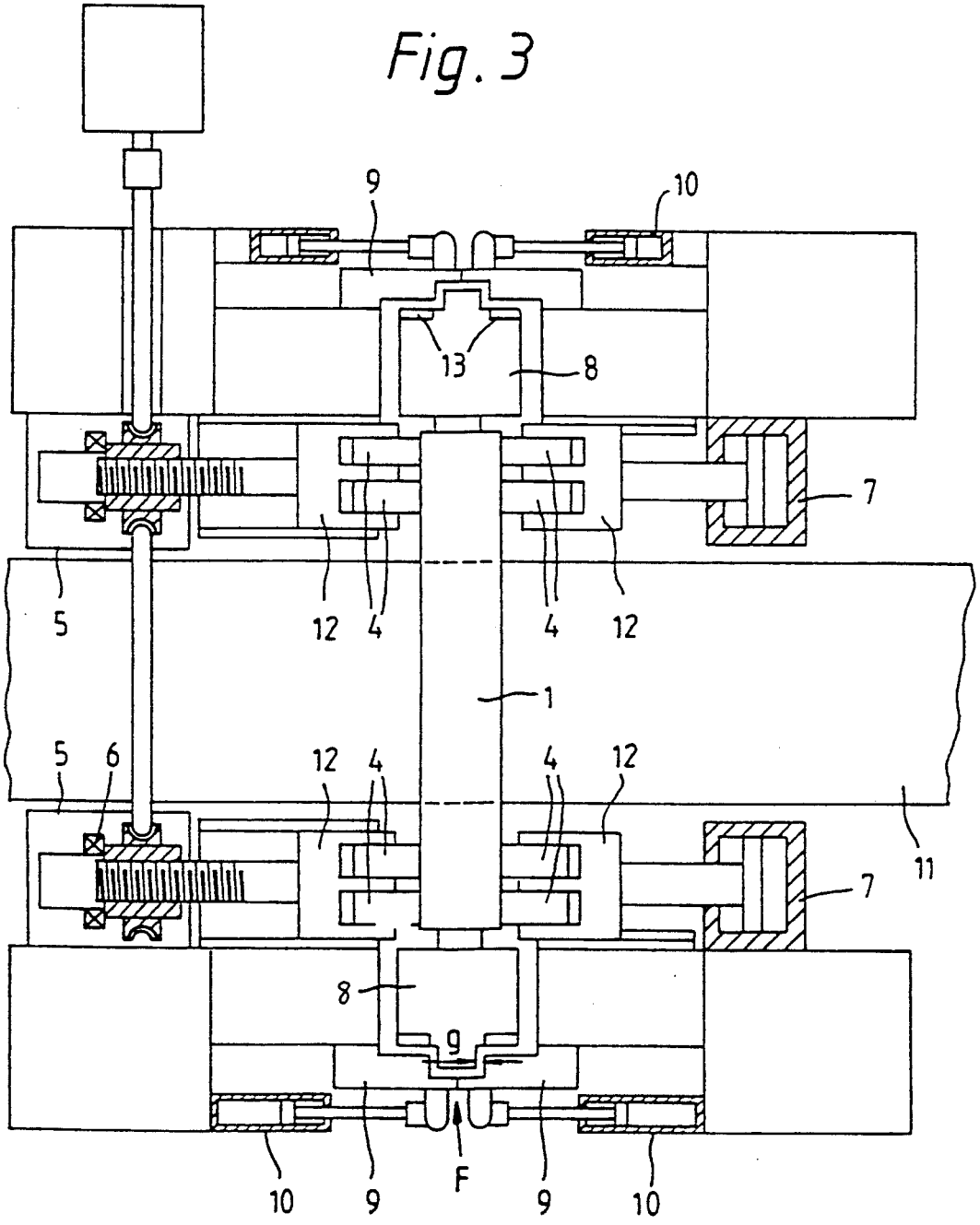
FIG. 3 is a section at the same line as FIG. 2 but shows another embodiment of the present invention.

FIGS. 1 and 2 show one embodiment of the rolling mill according to the present invention, which is a representative six-high rolling mill, in which a rolled material 11 is shown passing between a pair of work rolls 1. Intermediate backup rolls 2 and outer backup rolls 3 of increasing diameter are disposed above and below the work rolls 1. Generally speaking, the work rolls 1 have too small a diameter to receive a torque necessary for the rolling operations. Thus, the torque is transmitted to the intermediate rolls 2 or to the backup rolls 3, and by them to the work rolls. The backup rolls 2 and 3 are thus effective to support the work rolls 1 vertically and transmit rotational drive to them, in known manner.

The work rolls 1 are supported at the entrance and exit sides of the rolled material 11 and at their barrel portions (i.e. regions having the same diameter as the work regions contacted by the material 11) outside the maximum width of the material 1 by support rollers 4. These support rollers 4 are individually supported in a rotatable manner by brackets 12. These brackets 12 are moved and are supported at one of the entrance and exit sides of the material 11 by mechanical positioning means 5, specifically a worm-screw and rotating nut device driven by a drive motor 5*a*, and at the other side by hydraulic cylinders 7. Load cells 6 detect load applied by the positioning means 5. Note that FIG. 1 indicates three positions of the rolls 1 and rollers 4, explained below. Moreover, the work rolls 1 are equipped at their two ends with bearing boxes 8 which accommodate bearings supporting the work rolls 1. The bearing boxes 8 have their sides facing in the horizontal direction (rolling direction) arranged with a small gap g from other parts. Keeper plates 9 are thus arranged with the small gap g from the bearing boxes 8 and can be moved by cylinders 10.

The vertical support of the bearing blocks 8 is not shown in the drawings, for the sake of clarity. It is performed in a known manner by providing flat horizontal upper and lower surfaces on the bearing blocks 8, which surfaces can slide horizontally on upper and lower supports. The vertical work roll bending force is applied through these upper and lower supports, but does not prevent horizontal shifting of the bearing blocks 8. Roller bearings 13 transmit axial force to the keeper plates 9, to restrain axial movement, while allowing the horizontal movement of the bearing boxes 8.

Next the operation of the structure of the present embodiment will be described.

The horizontal bending force applied to the work rolls 1 consists of not only the driving tangential force transmitted from the intermediate backup rolls 2 but also the tensions applied in the direction of movement to the left hand and right hand portions of the rolled material 11. To counteract the bending force, an optimum horizontal offset $\delta_1$ or $\delta_2$ according to the direction of movement of the material 1 and the rolling conditions is selected so as to establish a horizontal component of the rolling load which at least partly balances the aforementioned horizontal bending force. The offset $\delta_1$ or $\delta_2$ is an offset of the vertical rolling plane defined by the axes of the work rolls 1 relative to the vertical backup roll plane defined by the axes of the intermediate rolls 2.

The right hand and left hand support rollers 4 have their positions adjusted by the positioning means 5 for over a range of positions on both sides of the state of zero offset. This adjustment is accomplished under the geometrical conditions which are determined by the diameters of the work rolls 1 and the support rollers 4, and may be selected such that the pushing force $P_B$ of the hydraulic cylinders 7 acting as a prestressing force and the pushing force $P_A$ of the positioning means 5 indicated by load cells 6 are equalized by the right hand hydraulic cylinders 7.

During the rolling operation, the offset may be so adjusted as to equalize the pushing force $P_A$ of the positioning means 5 and the pushing force $P_B$ of the hydraulic cylinders 7 (i.e., $P_A = P_B$) This is an ideal condition. In practice, the force applied by the hydraulic cylinders 7 is chosen so that the work rolls are always located against the support rollers held by the mechanical positioning means 5. In this way the offset position of the work rolls is maintained, and the horizontal rolling forces are accommodated.

Due to the high-rigidity supporting structure of the present invention, however, the offset may be decided in most cases to the value which has been preset in advance for each reversal of the direction of rolling.

The embodiment shown in FIGS. 1 and 2 adopts the of FIG. 4(*a*). In this embodiment, the bending of the work rolls 1 is larger than that in the case of FIG. 4(*b*), but the reaction $R_1$ to be applied to the support rolls 4 can be weaker than the reaction $R_2$ so that the entire structure can be simplified, permitting smaller sizes of components.

FIG. 4 shows another embodiment of the present invention. In this embodiment, the support rollers 3 are arranged further to restrain twisting in the horizontal plane and again act at portions of the work rolls 1 having the barrel diameter outside the material 11. Thus, this embodiment adopts the concept of FIG. 4(*b*).

Specifically, a plurality of support rollers 4, in this case two. are provided for each bracket 12 and together have a sufficient surface length in the axial direction. At the same time, at least one of the right hand and left hand support rollers 4 is so firmly supported that it may not be twisted by disturbances. The two support rollers 4 at each side are thus effectively equivalent to a long rigid roller. It is achieved in this way to support the two ends of the work rolls 1 fixedly. It is recommended that the inner support rollers 4 are thicker so as to have a larger capacity than the outer ones.

Since the surfaces of the work rolls 1 to contact with the material 11 are free, the aforementioned embodiments are suitable for application to a high-speed rolling mill in which the cooling capacity of the work rolls 1 with a roll coolant has to be improved. Coolant may easily be supplied to the roll surface. In addition, the embodiments provide a structure in which distortion of the working rolls is not likely.

In the embodiment of FIG. 1, when the diameter of the work rolls 1 is changed by a large amount, the corresponding direction of movement of the support rollers 4 is in parallel with the line joining points 0 and E, as shown in FIG. 1. This is due to the arrangement of the positioning means 5 and cylinders 7. Thus, for any work roll diameter, the rollers 4 make contact at the point where the tangent to the work roll is vertical (when the work roll is at the zero offset location). The vertical bending force for the work rolls 1 can thus be held constant, independent of the work roll diameter. An additional merit is that the vectors $A_1$-$B_1$ and $B_1$-$C_1$ are opposed at offset $\delta_1$, the vectors $A_2$-$B_2$ and $B_2$-$C_2$ are opposed at the centre position and further the vectors $A_3$-$B_3$ and $B_3$-$C_3$ are opposed at offset $\delta_2$. In other words, the correction of the vertical bending force can be made unnecessary even for a different offset or working roll diameter.

The positioning means 5 and the hydraulic cylinders 7 may alternatively be simply arranged to move parallel to or at a small angle of inclination to the direction of movement of the rolled material. If, in this case, the work roll diameter is changed, the vertical bending force to be applied to the work rolls by the work roll bender 1 may have to be corrected according to the geometrical conditions.

The work rolls 1 are equipped at their two ends with the bearing boxes 8 arranged so that the work roll bending (in the vertical direction—not shown here) is adjustably applied to control the shape of the rolled product, in known manner. The bearing boxes 8 have at their horizontally facing sides sufficient gaps g so that they will not interfere with the horizontal offset changes. The bearing boxes are thus substantially unrestrained in the horizontal rolling direction. As a result, it is possible not only to prevent the hysteresis caused by friction at the sides of the bearing boxes 8 but also to require no offset adjusting means for the bearing boxes 8, thus simplifying the structure.

The work rolls 1 are subjected during rolling to a thrust in the roll axis direction. Thus, the keeper plates 9 are provided. In the rolling mill having a variable offset, as in the present invention, the functions required of the keeper plates 9 are a holding function against the movement in the roll axis direction, a function to allow the working rolls 1 to move freely in the horizontal and vertical directions, and a function to prevent the bearing boxes 8 from turning more than is permissible.

To achieve these functions, the work rolls 1 have to be prevented from being moved by the axial thrust while being allowed to move freely by the small gaps g between the keeper plates 9 and the sides of the bearing boxes 8. The keeper plates can be adjusted in position and also withdrawn completely to allow roll changing, by the cylinder 10. When the keeper plates 9 are shut, they contact at a point F. Thus the plates 9 and cylinders 10 should have lengths of stroke corresponding to the desired offset change, in addition to the length of stroke required for retraction of the keeper plates.

It is not preferable that the bearing boxes 8 be not equally between the right hand and left hand sides when the work rolls are to be replaced i.e. not at the symmetrical position. It is, therefore, necessary to bring the bearing boxes 8 to the predetermined operating positions. If the bearing boxes 8 are to be offset rightward, for example, this offset can be accomplished by making the pushing force of the cylinder at the left hand side larger than that at the righthand side and by retracting the hydraulic cylinders. If the bearing boxes are to be offset leftward, on the other hand, this offset can be accomplished by making the pushing force at the righthand side larger than at the lefthand side and by retracting the positioning means 5.

When the working rolls 1 are to be replaced, generally speaking, it is necessary to retract the positioning means 5, the hydraulic cylinders 7 and the keeper plates 9.

If, on the other hand, the roll replacement is to be accomplished from the so-called working side of the mill (lower side in FIG. 2), the keeper plates 9 at the drive side (upper side in FIG. 2) need not be fully opened, and the strokes of the cylinders 10 may be reduced to an amount sufficient to establish a movement corresponding to the offset change during the rolling operation. As a result, moreover, the upper keeper plates 9 can act as stops when the new work rolls 1 are inserted.

Moreover, the keeper plates 9 may be disposed only at one upper or lower side, as shown in FIGS. 5 and 6, to accomplish both the pushing and retracting actions.

In the work rolls 1 on the other hand, an axial force is ordinarily established by some error and is supported by the bearing boxes 8 and the keeper plates 9. As has been described, the disturbances resulting from the rolling-directional horizontal forces can be prevented or reduced, but the disturbances resulting from the axial force are not prevented yet. The latter disturbances resulting from the axial force can be effectively prevented by interposing directly moving bearings such as roller bearings 13 between the bearing boxes 8 and the keeper plates 9 to allow smooth vertical bending of the working rolls and the vertical movements of the bearing boxes 8 when the thickness of the material 11 is changed.

The description thus far made is directed to the structures in which the upper and lower support rollers 4 are individually moved, but the support rollers 4 may be simultaneously moved. One example of this is shown in FIG. 7, in which the right hand support rollers on the one hand and the left hand support rollers 4 on the other hand are supported by the common brackets 12 and the work roll 1 is clamped by the positioning means 5 and the hydraulic cylinder 7. In order to follow more or less the vertical movements of the working roll 1, the cylinder 7 has its trailing end hinged by means of a pin so that it can be inclined. Since, in the case of this structure, the vectors $A_2$-$B_2$ and $B_2$-$C_2$ are not always able to form one straight line as a result of the change in the offset, the force corresponding to the vertical bending component of the work roll 1 resulting from the clamping force has to be compensated for by applying a bending force at the bearing boxes 8.

In the embodiment of FIGS. 8 and 9, the supporting brackets 12 for the support rollers 4 are mounted on the bearing boxes 8 so as to be slidable with the boxes 8 in the horizontal direction, i.e. the direction of movement of the rolled material 1. The positioning means 5 and the hydraulic cylinders 7 are mounted on the frame 15 of the mill. At points K, the actuating rods of the positioning means 5 and cylinders 7 make pushing contact with the rear faces of the brackets 12, but are not attached to the brackets 12. As in the other embodiments, the support rollers 4 engage the work rolls 1 at their barrel diameter, outside the region contacted by the rolled material 1.

To remove a pair of work rolls 1, the keeper plates 9 are withdrawn by cylinders 10 and the bearing boxes 8 with the brackets 12 and rollers 4 are removed with the rolls 1. To permit this, the actuating rods of the positioning means 5 and the cylinders 7 are slightly withdrawn at the contact points K.

This arrangement can provide several advantages. For each set of work rolls 1, the support rollers 4 can be mounted on the bearing boxes 8 with the correct alignment with respect to the rolls 1. This avoids any generation of vertical force by the horizontal support force applied, when the roll diameter changes. Since the support rollers 4 and brackets 12 are extracted from the mill with the work rolls 1, maintenance of the support rollers 4 is easy. The arrangement allows quick changing of work rolls.

The rear face of the brackets 12 must be sufficiently large to allow the actuating rods of the positioning means 5 and the cylinders 7 to push effectively, even though the vertical position of the support rollers varies with varying work roll diameter.

FIG. 10 shows one embodiment of a control system for the rolling method of the present invention.

It is preferred in the invention that control means, forming part of the mill controller, are provided to control and coordinate the movements of the support rollers 4, by means of the positioning means 5 and the hydraulic cylinders 7. The support rollers 4 are moved in concert, preferably in unison, by this control means, so as to bring the work rolls 1 to the desired offset position. The appropriate pressure is maintained in the hydraulic cylinder 7 during rolling, so as to keep the work rolls 1 at the desired offset location. Preferably during reversing rolling, the offset position is chosen so that the net horizontal force on the work rolls 1 resulting from the rolling torque, the rolling force and the front and back tensions of the rolled material acts in the same direction during both forward and reverse rolling. In that case, the hydraulic cylinders 7 can be set to apply a force to the work rolls appropriate to oppose this net force, and thereby maintain the work rolls in a single position, avoiding the need for movement of the rolls between passes of the material.

FIG. 10 diagrammatically illustrates the control means. A programmed data processing unit (DPU) has input data relating to rolling torque T, rolling force P, front tension $T_f$, back tension $T_b$, work roll diameter $D_w$ and backup roll diameter $D_B$ for a given rolling operation in the rolling schedule. $D_B$ is the diameter of the backup roll contacting the work roll. T and P depend on the material to be rolled, in accordance with well-known principles. The DPU calculates the offset δ of the work rolls, for example from the equation $$\frac{2T}{D_w} + \frac{T_b}{2} = \frac{2\delta \cdot P}{D_B + D_w} + \frac{T_f}{2}$$

This equation is derived from the requirement that the bending force Q, for one work roll, shall be zero, Q being given by $$Q = (F_2 + T_f) - (F_1 + T_b)$$

where $F_1$ is the frictional force required to drive the work rolls and $F_2$ is the horizontal component of the rolling force. In practice, as already mentioned, a different value of Q may be chosen at least for reversing rolling.

The value of δ calculated by the DPU is fed to the mill controller, which causes adjustment of the offset position of the rollers 4 through the positioning means 5 and hydraulic cylinders 7.

The embodiments thus far described are of six-high rolling mills, but the present invention can be applied to either a four-high rolling mill having no intermediate rolls or a vertically asymmetric rolling mill using a small-diameter work roll at the upper or the lower side.

What is claimed is:

1. A rolling mill for rolling metal strip moving in a horizontal rolling direction, having a. a pair of work rolls having axes defining a vertical rolling plane, axial ends and work regions between and spaced from said ends for engaging strip being rolled, b. a pair of backup rolls having axes defining a vertical backup roll plane and contacting said work rolls to support them in the vertical direction and arranged to transmit rotational drive to said work rolls, c. bearings for said axial ends of said work rolls to restrain axial movement of said work rolls, said bearings being horizontally shiftable in said horizontal rolling direction, d. means for accommodating said bearings so as to allow said bearings to move substantially unrestrained within a limited region in said horizontal rolling direction during rolling, and e. a plurality of support rollers for said work rolls providing support and contacting said work rolls at locations which are confined to intermediate regions of said work rolls between said work regions and said bearings, said support rollers being displaceable so as to locate and restrain said work rolls at a plurality of selectable positions in said horizontal rolling direction at which positions said vertical rolling plane is offset from said vertical backup roll plane.

2. A rolling mill according to claim 1 further having means for applying vertical forces to said bearings thereby to apply bending forces to said work rolls tending to control bending of said work rolls in said vertical rolling plane.

3. A rolling mill according to claim 1 wherein said intermediate regions of said work rolls contacted by said support rollers have the same diameter as said work regions.

4. A rolling mill according to claim 1 having control means for said support rollers adapted and arranged to move all said support rollers in the same direction so as to move said work rolls to a predetermined one of said selectable positions.

5. A rolling mill according to claim 1 wherein each said work roll is supported by said support rollers on both sides in said horizontal rolling direction.

6. A rolling mill according to claim 5 wherein said support rollers are displaceable so that said plurality of selectable positions of said work rolls includes offset positions of said vertical rolling plane at both sides of said backup roll plane.

7. A rolling mill according to claim 4 wherein said support rollers at a first side of said work rolls are positioned by first means providing position control of said support rollers on said first side thereby to position said work rolls, and said support rollers at the second side of said work rolls are pressed by second means providing control of the force applied by said rollers on said second side to said work rolls to maintain the position of said work roll positioned by said first means.

8. A rolling mill according to claim 7 wherein at said first side said first means provides mechanically adjustable predetermined location of said support rollers and at said second side said second means is adapted to apply an adjustable force hydraulically to said support rollers.

9. A rolling mill according to claim 1 wherein, at each said intermediate region of said work rolls contacted by said support rollers, there are at least two said support rollers spaced apart in the axial direction of the work roll.

10. A rolling mill according to claim 9, wherein the respective ones of said support closest to the work region of the work rolls are thicker than ones of said support rollers spaced further from the work region.

11. A rolling mill according to claim 9 wherein said at least two support rollers at each said intermediate region are rigidly linked to each other so as together to resist bending of the work roll in said horizontal rolling direction.

12. A rolling mill according to claim 11, wherein the respective ones of said support rollers closest to the work region of the work rolls are thicker than ones of said support rollers spaced further from the work region.

13. In a rolling mill for rolling metal strip moving in a horizontal rolling direction, wherein work rolls which engage said strip are supported vertically by backup rolls through which drive is applied to said work rolls and are supported in said horizontal rolling direction by support rollers contacting said work rolls at locations confined to intermediate regions between the work regions and bearings for said work rolls, the improvement that means are provided for accommodating said bearings for said work rolls so as to allow the bearing to shift substantially unrestrained within a limited region in said horizontal rolling direction so that said work rolls are shiftable in said horizontal rolling direction, and there are provided mechanical position control means disposed at one side of said work rolls for controlling said support rollers so that said support rollers shift said work rolls to a predetermined location at which the vertical axial plane of said work rolls is offset in said horizontal rolling direction from the vertical axial plane of said backup rolls, and hydraulic force control means are disposed at an opposite side to said mechanical position control means for applying adjustable force to said support rollers so that said support rollers maintain said work rolls at said predetermined location during rolling.

14. A rolling mill according to claim 13 further comprising means for applying vertical forces to said bearings tending to control bending of said work rolls in their vertical axial plane.

15. A rolling mill for rolling metal strip moving in a horizontal rolling direction, comprising:

a pair of work rolls having axes defining a vertical rolling plane, axial ends and work regions between and spaced from said ends for engaging strip being rolled;

a pair of backup rolls having axes defining a vertical backup roll plane and contacting said work rolls to support them in the vertical direction and arranged to transmit rotational drive to said work rolls, bearings for said axial ends of said work rolls to restrain axial movement of said work rolls, said bearings being horizontally shiftable in said horizontal rolling direction, means for accommodating said bearings so as to allow said bearings to move substantially unrestrained within a limited region in said horizontal rolling direction during rolling operation;

a plurality of support rollers for said work rolls providing support therefor in said horizontal rolling direction and contacting said work rolls at locations which are confined to intermediate regions of said work rolls between said work regions and said bearings, first means for providing mechanically adjustable predetermined location of said support rollers at a first side of said work rolls to position said work rolls at a predetermined position, and second means for applying an adjustable force hydraulically to said supports at a second side of said work rolls opposite to said first side thereby to maintain said work rolls at said predetermined position at which said vertical rolling plane is offset from said vertical backup roll plane.

16. A rolling mill according to claim 15, wherein pairs of keeper plates are provided for restraining axial movement of said work rolls, each pair of said keeper plates being arranged horizontally, perpendicularly to the axes of said work rolls and in opposition to each other, and actuated by hydraulic cylinders to provide a space therebetween sufficient for said work rolls to axially pass through said space when said work rolls are replaced for new ones.

17. A rolling mill according to claim 15, wherein said first means include load cells for detecting force applied thereon.

18. A rolling mill according to claim 15, wherein said first means includes brackets connected to said support rollers, respectively, and mechanical positioning means connected to said brackets for mechanically setting said support rollers at the predetermined location, and wherein said second means includes brackets connected to said support rollers and hydraulic cylinder means for applying the adjustable force to said support rollers.

19. A rolling mill according to claim 18, wherein said brackets are mounted on bearing boxes for said bearings so as to be slidable with said bearing boxes in said horizontal rolling direction.

20. In a method of operating a rolling mill for metal strip wherein the strip moving in a horizontal rolling direction is rolled by a pair of work rolls which are driven and supported vertically by a pair of backup rolls and are supported in said horizontal rolling direction by a plurality of support rollers which engage locations of said work rolls confined to intermediate regions between work regions where said work rolls contact strip being rolled and bearings for said work rolls, the improvement of said bearings being substantially unrestrained against movement in said horizontal rolling direction during rolling, of applying to said bearings during rolling vertical forces tending to control bending of said work rolls in a vertical plane and of applying to said work rolls through said support rollers during rolling horizontal forces tending to control bending of said work rolls in said horizontal rolling plane, said vertical forces and said horizontal forces being applied substantially independent of one another.

21. In a method of operating a rolling mill for metal strip wherein the strip moving in a horizontal rolling direction is rolled by a pair of work rolls which are driven and supported vertically by a pair of backup rolls and are supported in said horizontal rolling direction by a plurality of support rollers which engage locations of said work rolls confined to intermediate regions between work regions where said work rolls contact strip being rolled and bearings so as to move said work rolls to a predetermined offset position at which the vertical rolling plane in which their axes lie is offset from the vertical backup roll plane in which the axes of said backup rolls lie, and thereafter maintaining the position of said support rollers so as to maintain said work rolls at said predetermined offset position during a rolling operation, said predetermined offset position being selected so that the bending forces tending to bend said work rolls in said horizontal rolling direction during said rolling operation are less when said work rolls are at said predetermined offset position than when said vertical rolling plane coincides with said vertical backup plane, wherein said bearings for the work rolls are substantially unrestrained from movement in said horizontal rolling direction during rolling.

22. A method according to claim 21 including applying to said work rolls during the rolling operation forces tending to control bending of said work rolls in said vertical rolling plane.

23. A method of manufacturing rolled metal strip comprising:

supplying a metal strip to be rolled in a horizontal rolling direction to a pair of work rolls, vertically supporting and driving the work rolls by a pair of backup rolls, supporting said work rolls in said horizontal rolling direction by a plurality of support rollers which engage locations of said work rolls confined to intermediate regions between work regions where said work rolls contact the strip being rolled and bearings for said work rolls, supporting said bearings for said work rolls so as to allow said bearings to move freely within a limited region in said horizontal rolling direction during a rolling operation, wherein said support rollers are displaced so as to move said work rolls to a predetermined offset position at which a vertical rolling plane in which their axes lie is offset from a vertical backup roll plane in which aces of said backup rolls lie, and thereafter maintaining the position of said support rollers so as to maintain said work rolls at said predetermined offset position during said rolling operation, said predetermined offset position being selected so that the bending forces tending to bend said work rolls in said horizontal rolling direction during said rolling operation are less when said work rolls are at said predetermined offset position than when said vertical rolling plane coincides with said vertical backup plane.

24. A method according to claim 23, including applying to said work rolls during the rolling operation forces tending to control bending of said work rolls in said vertical rolling plane.

* * * * *